US011802255B2

(12) United States Patent
Elliott et al.

(10) Patent No.: US 11,802,255 B2
(45) Date of Patent: Oct. 31, 2023

(54) COMPOSITION AND METHOD FOR PREVENTING OR REDUCING LOW SPEED PRE-IGNITION IN DIRECT INJECTED SPARK-IGNITED ENGINES

(71) Applicants: CHEVRON ORONITE COMPANY LLC, San Ramon, CA (US); CHEVRON U.S.A. INC., San Ramon, CA (US)

(72) Inventors: Ian G. Elliott, Vacaville, CA (US); Amir Gamal Maria, Fremont, CA (US); Richard Eugene Cherpeck, Cotati, CA (US); Theresa Liang Gunawan, Emeryville, CA (US)

(73) Assignees: CHEVRON ORONITE COMPANY LLC, San Ramon, CA (US); CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 16/808,533

(22) Filed: Mar. 4, 2020

(65) Prior Publication Data

US 2020/0283695 A1 Sep. 10, 2020

Related U.S. Application Data

(60) Provisional application No. 62/815,795, filed on Mar. 8, 2019.

(51) Int. Cl.

| | |
|---|---|
| ***C10M 139/06*** | (2006.01) |
| ***C10M 139/00*** | (2006.01) |
| ***C10M 169/04*** | (2006.01) |
| *C10N 10/04* | (2006.01) |
| *C10N 30/12* | (2006.01) |
| *C10N 40/25* | (2006.01) |

(52) U.S. Cl.

CPC ..... *C10M 139/00* (2013.01); *C10M 139/06* (2013.01); *C10M 169/04* (2013.01); *C10M 2227/09* (2013.01); *C10N 2010/04* (2013.01); *C10N 2030/12* (2013.01); *C10N 2040/25* (2013.01)

(58) Field of Classification Search

CPC ..... C10M 139/00; C10M 139/06; C10M 169/04; C10M 2227/09; C10M 159/18; C10M 2207/09; C10M 2207/023; C10M 2219/044; C10M 2203/1025; C10M 2215/28; C10M 2215/064; C10M 2223/045; C10N 2010/04; C10N 2030/12; C10N 2040/25; C10N 2040/255; C10N 2030/42

See application file for complete search history.

(56) References Cited

U.S. PATENT DOCUMENTS

| | | | | |
|---|---|---|---|---|
| 2,419,360 | A | 4/1947 | McNab | |
| 3,003,859 | A | 10/1961 | Irish | |
| 3,082,071 | A * | 3/1963 | Hartle | C07C 49/92 44/362 |
| 4,036,605 | A | 7/1977 | Hartle | |
| 4,320,019 | A | 3/1982 | Hayashi | |
| 6,372,696 | B1 | 4/2002 | Tipton | |
| 2009/0048130 | A1 * | 2/2009 | Habeeb | C10M 163/00 508/366 |

OTHER PUBLICATIONS

International Search Report, dated Jul. 20, 2020, during the prosecution of International Application No. PCT/IB2020/051834.

Written Opinion of the International Searching Authority, dated Jul. 20, 2020, during the prosecution of International Application No. PCT/IB2020/051834.

* cited by examiner

*Primary Examiner* — Taiwo Oladapo

(57) ABSTRACT

Disclosed herein are improved lubricating compositions effective to prevent or reduce low speed pre-ignition in an engine, as well as to prevent or reduce corrosion of engine components. The lubricating compositions include a base oil combined with a calcium chelate complex, optionally in further combination with additional additives.

31 Claims, No Drawings

COMPOSITION AND METHOD FOR PREVENTING OR REDUCING LOW SPEED PRE-IGNITION IN DIRECT INJECTED SPARK-IGNITED ENGINES

CROSS-REFERENCE TO RELATED APPLICATION

This application claims the benefit U.S. Provisional Application 62/815,795, filed on Mar. 8, 2019, the contents of which are hereby incorporated in its entirety.

FIELD OF THE INVENTION

This disclosure relates to a lubricant composition that contains at least one calcium cyclic chelate complex, for instance a calcium chelate of a 1,3-dicarbonyl compound, ortho-ketophenol, 1,3-diimine, mixed chelates, and combinations thereof. The disclosure also relates to a lubricant composition that contains at least one calcium cyclic chelate complex for a direct injected, boosted, spark ignited internal combustion engine. This disclosure also relates to a method for preventing or reducing low speed pre-ignition in an engine lubricated with a formulated oil. The formulated oil has a composition that includes at least one oil soluble or oil dispersible calcium cyclic chelate complex.

BACKGROUND

In recent years, engine manufacturers have developed smaller engines which provide higher power densities and excellent performance while reducing frictional and pumping losses. This is accomplished by increasing boost pressures with the use of turbochargers or mechanical superchargers, and by down-speeding the engine by using higher transmission gear ratios allowed by higher torque generation at lower engine speeds. However, higher torque at lower engine speeds has been found to cause random pre-ignition in engines at low speeds, a phenomenon known as Low Speed Pre-Ignition, or LSPI, resulting in extremely high cylinder peak pressures, which can lead to catastrophic engine failure. The possibility of LSPI prevents engine manufacturers from fully optimizing engine torque at lower engine speed in such smaller, high-output engines.

One of the leading theories surrounding the cause of low speed pre-ignition (LSPI) is at least in part, due to auto-ignition of engine oil droplets that enter the engine combustion chamber from the piston crevice under high pressure, during periods in which the engine is operating at low speeds, and compression stroke time is longest (Amann et al. SAE 2012-01-1140).

Although some engine knocking and pre-ignition problems can be and are being resolved through the use of new engine technology, such as electronic controls and knock sensors, and through the optimization of engine operating conditions, there is a need for lubricating oil compositions which can decrease or prevent the LSPI problem, and also improve or maintain other performance such as wear and oxidation protection.

The present inventors have discovered a solution for addressing the problem of LSPI through the use of calcium cyclic chelate complex, for instance a calcium chelate of a 1,3-dicarbonyl compound, ortho-ketophenol, 1,3-diimine, mixed chelates, and combinations thereof.

SUMMARY

Disclosed herein are lubricating oil additives that reduce or eliminate low speed pre-ignition. Suitable additives include calcium cyclic chelate complexes, for instance a calcium chelate including one or more polydentate compounds, e.g., 1,3-dicarbonyl compounds, ortho-ketophenols, 1,3-diimines, and others.

The details of one or more embodiments are set forth in the descriptions below. Other features, objects, and advantages will be apparent from the description and from the claims.

DETAILED DESCRIPTION

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The term "boosting" is used throughout the specification. Boosting refers to running an engine at higher intake pressures than in naturally aspirated engines. A boosted condition can be reached by use of a turbocharger (driven by exhaust) or a supercharger (driven by the engine). "Boosting" allow engine manufacturers to use smaller engines which provide higher power densities to provide excellent performance while reducing frictional and pumping losses.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

The term "sulfated ash" as used herein refers to the non-combustible residue resulting from detergents and metallic additives in lubricating oil. Sulfated ash may be determined using ASTM Test D874.

The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using ASTM D 2896 test.

Unless otherwise specified, all percentages are in weight percent.

In general, the level of sulfur in the lubricating oil compositions of the present invention is less than or equal to about 0.7 wt. %, based on the total weight of the lubricating oil composition, e.g., a level of sulfur of about 0.01 wt. % to about 0.70 wt. %, 0.01 to 0.6 wt. %, 0.01 to 0.5 wt. %, 0.01 to 0.4 wt. %, 0.01 to 0.3 wt. %, 0.01 to 0.2 wt. %, 0.01 wt. % to 0.10 wt. %. In one embodiment, the level of sulfur in the lubricating oil compositions of the present invention is less than or equal to about 0.60 wt. %, less than or equal to about 0.50 wt. %, less than or equal to about 0.40 wt. %, less than or equal to about 0.30 wt. %, less than or equal to about 0.20 wt. %, less than or equal to about 0.10 wt. % based on the total weight of the lubricating oil composition.

In one embodiment, the levels of phosphorus in the lubricating oil compositions of the present invention is less than or equal to about 0.12 wt. %, based on the total weight of the lubricating oil composition, e.g., a level of phosphorus of about 0.01 wt. % to about 0.12 wt. %. In one embodiment, the levels of phosphorus in the lubricating oil compositions of the present invention is less than or equal to about 0.11 wt. %, based on the total weight of the lubricating oil composition, e.g., a level of phosphorus of about 0.01 wt. % to about 0.11 wt. %. In one embodiment, the levels of phosphorus in the lubricating oil compositions of the present invention is less than or equal to about 0.10 wt. %, based on the total weight of the lubricating oil composition, e.g., a level of phosphorus of about 0.01 wt. % to about 0.10 wt. %. In one embodiment, the levels of phosphorus in the lubricating oil compositions of the present invention is less than or equal to about 0.09 wt. %, based on the total weight of the lubricating oil composition, e.g., a level of phosphorus of about 0.01 wt. % to about 0.09 wt. %. In one embodiment, the levels of phosphorus in the lubricating oil compositions of the present invention is less than or equal to about 0.08 wt. %, based on the total weight of the lubricating oil composition, e.g., a level of phosphorus of about 0.01 wt. % to about 0.08 wt. %. In one embodiment, the levels of phosphorus in the lubricating oil compositions of the present invention is less than or equal to about 0.07 wt. %, based on the total weight of the lubricating oil composition, e.g., a level of phosphorus of about 0.01 wt. % to about 0.07 wt. %. In one embodiment, the levels of phosphorus in the lubricating oil compositions of the present invention is less than or equal to about 0.05 wt. %, based on the total weight of the lubricating oil composition, e.g., a level of phosphorus of about 0.01 wt. % to about 0.05 wt. %.

In one embodiment, the level of sulfated ash produced by the lubricating oil compositions of the present invention is less than or equal to about 1.60 wt. % as determined by ASTM D 874, e.g., a level of sulfated ash of from about 0.10 to about 1.60 wt. % as determined by ASTM D 874. In one embodiment, the level of sulfated ash produced by the lubricating oil compositions of the present invention is less than or equal to about 1.00 wt. % as determined by ASTM D 874, e.g., a level of sulfated ash of from about 0.10 to about 1.00 wt. % as determined by ASTM D 874. In one embodiment, the level of sulfated ash produced by the lubricating oil compositions of the present invention is less than or equal to about 0.80 wt. % as determined by ASTM D 874, e.g., a level of sulfated ash of from about 0.10 to about 0.80 wt. % as determined by ASTM D 874. In one embodiment, the level of sulfated ash produced by the lubricating oil compositions of the present invention is less than or equal to about 0.60 wt. % as determined by ASTM D 874, e.g., a level of sulfated ash of from about 0.10 to about 0.60 wt. % as determined by ASTM D 874.

Suitably, the present lubricating oil composition may have a total base number (TBN) of 4 to 15 mg KOH/g (e.g., 5 to 12 mg KOH/g, 6 to 12 mg KOH/g, or 8 to 12 mg KOH/g). Low Speed Pre-Ignition is most likely to occur in direct-injected, boosted (turbocharged or supercharged), spark-ignited (gasoline) internal combustion engines that, in operation, generate a break mean effective pressure level of greater than about 15 bar (peak torque), such as at least about 18 bar, particularly at least about 20 bar at engine speeds of from about 1500 to about 2500 rotations per minute (rpm), such as at engine speeds of from about 1500 to about 2000 rpm. As used herein, break mean effective pressure (BMEP) is defined as the work accomplished during one engine cycle, divided by the engine swept volume; the engine torque normalized by engine displacement. The word "brake" denotes the actual torque/power available at the engine flywheel, as measured on a dynamometer. Thus, BMEP is a measure of the useful power output of the engine.

In one embodiment of the invention, the engine is operated at speeds between 500 rpm and 3000 rpm, or 800 rpm to 2800 rpm, or even 1000 rpm to 2600 rpm. Additionally, the engine may be operated with a break mean effective pressure of 10 bars to 30 bars, or 12 bars to 24 bars.

LSPI events, while comparatively uncommon, may be catastrophic in nature. Hence drastic reduction or even elimination of LSPI events during normal or sustained operation of a direct fuel injection engine is desirable. In one embodiment, the method of the invention is such that there are less than 150 LSPI events/million combustion cycles (can also be expressed as 15 LSPI events/100,000 combustion cycles) or less than 100 LSPI events/million combustion cycles or less than 70 LSPI events/million combustion cycles or less than 60 LSPI events/million combustion cycles or less than 50 LSPI events/million combustion cycles or less than 40 LSPI events/million combustion cycles, less than 30 LSPI events/million combustion cycles, less than 20 LSPI events/million combustion cycles, less than 10 LSPI events/million combustion cycles, or there may be 0 LSPI events/million combustion cycles.

Therefore, in an aspect the present disclosure provides a method for preventing or reducing low speed pre-ignition in a direct injected, boosted, spark ignited internal combustion engine, said method comprising the step of lubricating the crankcase of the engine with a lubricating oil composition comprising at least one calcium cyclic chelate complex. In one embodiment, the amount of metal from the at least one calcium cyclic chelate complex is from about 100 to about 3000 ppm, from about 200 to about 3000 ppm, from about 250 to about 2500 ppm, from about 300 to about 2500 ppm, from about 350 to about 2500 ppm, from about 400 ppm to about 2500 ppm, from about 500 to about 2500 ppm, from about 600 to about 2500 ppm, from about 700 to about 2500 ppm, from about 700 to about 2000 ppm, from about 700 to about 1500 ppm in the lubricating oil composition. In one embodiment, the amount of metal from the calcium cyclic chelate complex is no more than about 2000 ppm or no more than 1500 ppm in the lubricating oil composition. In certain embodiments, the lubricating composition does not include any calcium salicylate compounds.

In one embodiment, the method of the invention provides a reduction in the number of LSPI events of at least 10 percent, or at least 20 percent, or at least 30 percent, or at least 50 percent, or at least 60 percent, or at least 70 percent, or at least 80 percent, or at least 90 percent, or at least 95 percent, compared to an oil that does not contain the at least one calcium cyclic chelate complex.

In another aspect, the present disclosure provides a method for reducing the severity of low speed pre-ignition events in a direct injected, boosted, spark ignited internal combustion engine, said method comprising the step of lubricating the crankcase of the engine with a lubricating oil composition comprising at least one calcium cyclic chelate complex. LSPI events are determined by monitoring peak cylinder pressure (PP) and mass fraction burn (MFB) of the fuel charge in the cylinder. When either or both criteria are met, it can be said that an LSPI event has occurred. The threshold for peak cylinder pressure varies by test, but is typically 4-5 standard deviations above the average cylinder pressure. Likewise, the MFB threshold is typically 4-5 standard deviations earlier than the average MFB (represented in crank angle degrees). LSPI events can be reported as average events per test, events per 100,000 combustion cycles, events per cycle, and/or combustion cycles per event. In one embodiment, the number of LSPI events, where both MFB02 and Peak Pressure (PP) Requirements that were greater than 90 bar of pressure, is less than 15 events, less than 14 events, less than 13 events, less than 12 events, less than 11 events, less than 10 events, less than 9 events, less than 8 events, less than 7 events, less than 6 events, is less than 5 events, less than 4 events, less than 3 events, less than 2 events, or less than 1 event per 100,000 combustion cycles. In one embodiment, the number of LSPI events that were greater than 90 bar was zero events, or in other words completely suppressed LSPI events greater than 90 bar. In one embodiment, the number of LSPI events where both MFB02 and Peak Pressure (PP) Requirements that were greater than 100 bar of pressure is less than 15 events, less than 14 events, less than 13 events, less than 12 events, less than 11 events, less than 10 events, less than 9 events, less than 8 events, less than 7 events, less than 6 events, is less than 5 events, less than 4 events, less than 3 events, less than 2 events, or less than 1 event per 100,000 combustion cycles. In one embodiment, the number of LSPI events that were greater than 100 bar was zero events, or in other words completely suppressed LSPI events greater than 100 bar. In one embodiment, the number of LSPI events where both MFB02 and Peak Pressure (PP) Requirements that were greater than 110 bar of pressure is less than 15 events, less than 14 events, less than 13 events, less than 12 events, less than 11 events, less than 10 events, less than 9 events, less than 8 events, less than 7 events, less than 6 events, is less than 5 events, less than 4 events, less than 3 events, less than 2 events, or less than 1 event per 100,000 combustion cycles In one embodiment, the number of LSPI events that were greater than 110 bar was zero events, or in other words completely suppressed LSPI events greater than 110 bar. For example, the number of LSPI events where both MFB02 and Peak Pressure (PP) Requirements that were greater than 120 bar of pressure is less than 15 events, less than 14 events, less than 13 events, less than 12 events, less than 11 events, less than 10 events, less than 9 events, less than 8 events, less than 7 events, less than 6 events, is less than 5 events, less than 4 events, less than 3 events, less than 2 events, or less than 1 event per 100,000 combustion cycles. In one embodiment, the number of LSPI events that were greater than 120 bar was zero events, or in other words completely suppressed very severe LSPI events (i.e., events greater than 120 bar).

It has now been found that the occurrence of LSPI in engines susceptible to the occurrence of LSPI can be reduced by lubricating such engines with lubricating oil compositions containing a calcium cyclic chelate complex. As calcium species, e.g., calcium-based detergents were known to cause LSPI, the ability of the presently disclosed cyclic calcium chelate complexes to reduce LSPI was heretofore unknown and unexpected.

The disclosure further provides the method described herein in which the engine is fueled with a liquid hydrocarbon fuel, a liquid nonhydrocarbon fuel, or mixtures thereof.

The disclosure further provides the method described herein in which the engine is fueled by natural gas, liquefied petroleum gas (LPG), compressed natural gas (CNG), or mixtures thereof.

Lubricating oil compositions suitable for use as passenger car motor oils conventionally comprise a major amount of oil of lubricating viscosity and minor amounts of performance enhancing additives, including ash-containing compounds. Conveniently, the metals as described herein are introduced into the lubricating oil compositions used in the practice of the present disclosure by one or more calcium cyclic chelate complex.

Oil of Lubricating Viscosity/Base Oil Component

The oil of lubricating viscosity for use in the lubricating oil compositions of this disclosure, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-diene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-4, 0W-8, 0W-12, 0W-16, 0W-20, 0W-26, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

Group I base oils generally refer to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

Group II base oils generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270).

Group III base oils generally refer to a petroleum derived lubricating base oil having less than 300 ppm sulfur, a saturates content greater than 90 weight percent, and a VI of 120 or greater.

Group IV base oils are polyalphaolefins (PAOs).

Group V base oils include all other base oils not included in Group I, II, III, or IV.

The lubricating oil composition can contain minor amounts of other base oil components. For example, the lubricating oil composition can contain a minor amount of a base oil derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude.

Suitable natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Suitable synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of synthetic lubricating oils include, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500-1000, diethyl ether of polypropylene glycol having a molecular weight of 1,000-1,500, etc.) or mono- and polycarboxylic esters thereof such as, for example, the acetic esters, mixed $C_3$-$C_8$ fatty acid esters, or the $C_{13}$ oxo acid diester of tetraethylene glycol.

Yet another class of synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorous containing acids, e.g., tricresyl phosphate, trioctyl phosphate, diethyl ester of decane phosphionic acid, etc., polymeric tetrahydrofurans and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

Other useful fluids of lubricating viscosity include non-conventional or unconventional base stocks that have been processed, preferably catalytically, or synthesized to provide high performance lubrication characteristics.

As used herein, a calcium cyclic chelate complex is a compound including at least one ring, formed by the interaction of a calcium ion and a polydentate ligand. As used herein, polydentate ligands are compounds having at least two Lewis basic atoms capable of associating with the same calcium ion. Lewis basic atoms include oxygen, nitrogen, sulfur, and phosphorus. A complex between a calcium ion and two Lewis basic atoms in the same ligand may be designated a bidentate complex, whereas a complex between a calcium ion and a compound having three Lewis basic atoms in the same ligand may be designated a tridentate complex. In some instances, the chelate ring complex can be a compound having the formula:

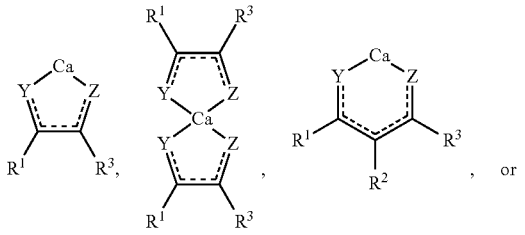

-continued

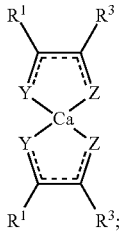

wherein:

‖ represents a single or double bond, providing that valence is satisfied;

Y is in each case independently selected from O, S, $NR^{n1}$;

Z is in each case independently selected from O, S, $NR^{n2}$; and $R^1$, $R^2$, $R^3$, $R^{n1}$, and $R^{n2}$ are independently selected from $R^a$, $OR^b$, and $N(R^b)_2$; wherein $R^a$ is in each case independently selected from hydrogen, $C_{1-8}$alkyl, $C_{2-8}$alkenyl, $C_{2-8}$alkynyl, aryl, $C_{1-8}$heteroaryl, $C_{3-8}$cycloalkyl, or $C_{1-8}$heterocyclyl; $R^b$ is in each case independently selected from $C_{1-8}$alkyl, $C_{2-8}$alkenyl, $C_{2-8}$alkynyl, aryl, $C_{1-8}$heteroaryl, $C_{3-8}$cycloalkyl, or $C_{1-8}$heterocyclyl; and wherein any two or more of $R^1$, $R^2$, $R^3$, $R^{n1}$, and $R^{n2}$ can together form a ring.

The skilled person is aware that the calcium chelates depicted above can be associated with one or more monodentate ligands, providing charge balance and satisfying the valency requirements of the calcium atom and/or saturating its co-ordination sphere. Exemplary such ligands include ionic species such as hydroxide, halides, carboxylates, and bicarbonates; and non-ionic species such as water, carboxylic acids, amines, primary amines, secondary amines, tertiary amines, and ammonia. The cyclic calcium chelate complexes disclosed herein can be associated with non-ionic and/or ionic monodentate ligands depending on the molecular identity of the chelate, as well as what other chemical compounds are present in the lubricating composition. Unless specified to the contrary, any depiction of a cyclic calcium chelate complex neither excludes nor requires the presence of one or more monodentate ligands.

As used herein, a mixed chelate is a complex in which Y and Z are not the same heteroatom.

The skilled person understands that chelate complexes such as depicted above may be in equilibrium with two or more tautomer species (defined herein as compounds differing only in the location of double bonds and acidic protons). For instance, a chelate can have various tautomeric forms:

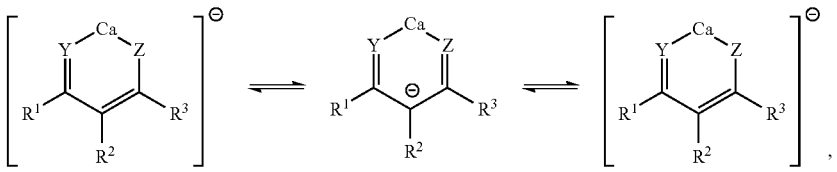

The ratio of the individual tautomeric species is dependent not only on the specific identities of Y, Z, $R^1$, $R^2$, and $R^3$, but also on specific features of the lubricating composition in which the complex is placed. Moreover, either of Y or Z may be protonated depending on the molecular composition of the chelate and the local environment. Depending on the specific nature of $R^1$, $R^2$, $R^3$, Y, and Z additional tautomeric species may also exist. Unless explicitly stated to the contrary, the depiction of one tautomer is not intended to exclude any other possible tautomer, nor even require the presence of the specifically depicted tautomer species.

In certain embodiments, the chelate complex is a six membered complex, and Y and Z are each oxygen:

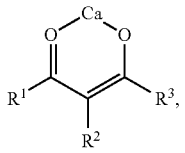

wherein $R^1$, $R^2$, and $R^3$ have the meanings given above. In the above depicted equilibrium, the $sp^3$ hybridized oxygen is depicted without a hydrogen atom, but the skilled person understands such an atom may be present in certain circumstances. Depending on specific conditions, the calcium atom may be further substituted with one or more monodentate ligands.

In certain embodiments, the chelate complex is a six membered complex, and Y and Z are each nitrogen:

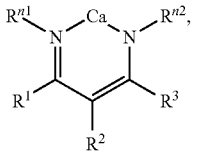

wherein $R^1$, $R^2$, $R^3$, $R^{n1}$, and $R^{n2}$ have the meanings given above. In the above depicted equilibrium, the $sp^3$ hybridized nitrogen is depicted without a hydrogen atom, but the skilled person understands such an atom may be present in certain circumstances. Depending on specific conditions, the calcium atom may be further substituted with one or more monodentate ligands.

In yet further embodiments, the chelate complex is a six membered mixed chelate complex, and one of Y and Z is oxygen, and the other is nitrogen:

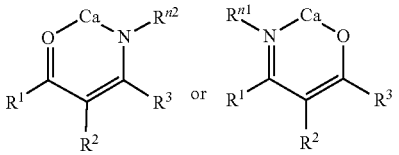

wherein $R^1$, $R^2$, $R^3$, $R^{n1}$, and $R^{n2}$ have the meanings given above. In the above depicted equilibrium, the $sp^3$ hybridized atom is depicted without a hydrogen atom, but the skilled person understands such an atom may be present in certain circumstances. Depending on specific conditions, the calcium atom may be further substituted with one or more monodentate ligands.

In some embodiments, $R^1$ and $R^3$ are each $C_{1-8}$alkyl groups, and $R^2$ (when present) is hydrogen. Suitable $C_{1-8}$alkyl groups include methyl, ethyl, n-propyl, isopropyl, n-butyl, iso-butyl, and tert-butyl. Such $C_{1-8}$alkyl groups may be independently substituted one or more times. Suitable substituents include, but are not limited to, alkoxy, alkenyl, alkynyl, cycloalkyl, heterocycloalkyl, aryl, heteroaryl, aldehyde, amino, carboxylic acid, ester, ether, halide, hydroxy, ketone, nitro, silyl, sulfo-oxo, phosphine or thiol.

In some aspects of the invention, $R^1$ is O—$C_{1-8}$alkyl, for instance methoxy, ethoxy, n-propoxy, isopropoxy, n-butoxy, iso-butoxy, or tert-butoxy, and $R^3$ is $C_{1-8}$alkyl, for instance, methyl, ethyl, n-propyl, isopropyl, n-butyl, iso-butyl, and tert-butyl. Such O—$C_{1-8}$alkyl groups may be substituted as described for $C_{1-8}$alkyl groups. In some instances, $R^2$ is $C_{1-8}$alkyl, and may form a ring with either or both of $R^1$ and $R^3$. Exemplary five and six membered complexes are depicted below:

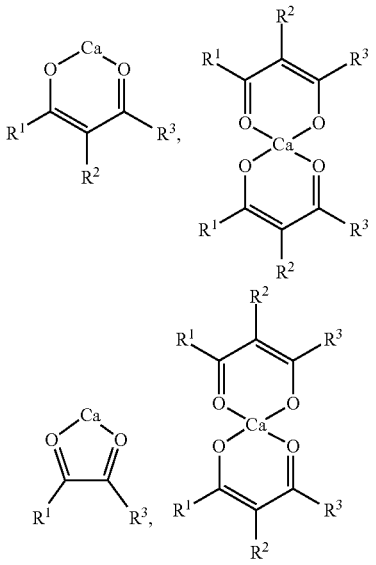

| $R^1$=$R^a$ $R^a$ | $R^2$=$R^a$ $R^a$ | $R^3$=$R^a$ $R^a$ | $R^1$=$OR^b$ $R^b$ | $R^2$=$R^a$ $R^a$ | $R^3$=$R^a$ $R^a$ |
|---|---|---|---|---|---|
| tert-butyl | H | methyl | tert-butyl | H | methyl |
| tert-butyl | H | ethyl | tert-butyl | H | ethyl |
| tert-butyl | H | n-propyl | tert-butyl | H | n-propyl |
| tert-butyl | H | isopropyl | tert-butyl | H | isopropyl |
| tert-butyl | H | n-butyl | tert-butyl | H | n-butyl |
| tert-butyl | H | isobutyl | tert-butyl | H | isobutyl |
| tert-butyl | H | tert-butyl | tert-butyl | H | tert-butyl |
| Methyl | H | methyl | Methyl | H | methyl |
| Methyl | H | ethyl | Methyl | H | ethyl |
| Methyl | H | n-propyl | Methyl | H | n-propyl |
| Methyl | H | isopropyl | Methyl | H | isopropyl |
| Methyl | H | n-butyl | Methyl | H | n-butyl |
| Methyl | H | isobutyl | Methyl | H | isobutyl |
| Ethyl | H | ethyl | Ethyl | H | ethyl |
| Ethyl | H | n-propyl | Ethyl | H | n-propyl |
| Ethyl | H | isopropyl | Ethyl | H | isopropyl |
| Ethyl | H | n-butyl | Ethyl | H | n-butyl |
| Ethyl | H | isobutyl | Ethyl | H | isobutyl |
| isopropyl | H | n-propyl | isopropyl | H | n-propyl |
| isopropyl | H | isopropyl | isopropyl | H | isopropyl |
| isopropyl | H | n-butyl | isopropyl | H | n-butyl |
| isopropyl | H | isobutyl | isopropyl | H | isobutyl |
| tert-butyl | H | methyl | tert-butyl | H | methyl |

-continued

| | | | | | |
|---|---|---|---|---|---|
| tert-butyl | H | ethyl | tert-butyl | H | ethyl |
| tert-butyl | H | n-propyl | tert-butyl | H | n-propyl |
| tert-butyl | H | isopropyl | tert-butyl | H | isopropyl |
| tert-butyl | H | n-butyl | tert-butyl | H | n-butyl |
| tert-butyl | H | isobutyl | tert-butyl | H | isobutyl |
| tert-butyl | H | tert-butyl | tert-butyl | H | tert-butyl |
| Methyl | methyl | methyl | Methyl | methyl | methyl |
| Methyl | methyl | ethyl | Methyl | methyl | ethyl |
| Methyl | methyl | n-propyl | Methyl | methyl | n-propyl |
| Methyl | methyl | isopropyl | Methyl | methyl | isopropyl |
| Methyl | methyl | n-butyl | Methyl | methyl | n-butyl |
| Methyl | methyl | isobutyl | Methyl | methyl | isobutyl |
| Ethyl | methyl | ethyl | Ethyl | methyl | ethyl |
| Ethyl | methyl | n-propyl | Ethyl | methyl | n-propyl |
| Ethyl | methyl | isopropyl | Ethyl | methyl | isopropyl |
| Ethyl | methyl | n-butyl | Ethyl | methyl | n-butyl |
| Ethyl | methyl | isobutyl | Ethyl | methyl | isobutyl |
| isopropyl | methyl | n-propyl | isopropyl | methyl | n-propyl |
| isopropyl | methyl | isopropyl | isopropyl | methyl | isopropyl |
| isopropyl | methyl | n-butyl | isopropyl | methyl | n-butyl |
| isopropyl | methyl | isobutyl | isopropyl | methyl | isobutyl |

| $R^1$=$OR^b$ $R^b$ | $R^2$=$R^a$ $R^a$ | $R^3$=$OR^b$ $R^b$ | $R^1$=$OR^b$ $R^b$ | $R^2$=$OR^b$ $OR^b$ | $R^3$=$R^a$ $R^a$ |
|---|---|---|---|---|---|
| tert-butyl | H | methyl | Methyl | methyl | methyl |
| tert-butyl | H | ethyl | Methyl | methyl | ethyl |
| tert-butyl | H | n-propyl | Methyl | methyl | n-propyl |
| tert-butyl | H | isopropyl | Methyl | methyl | isopropyl |
| tert-butyl | H | n-butyl | Methyl | methyl | n-butyl |
| tert-butyl | H | isobutyl | Methyl | methyl | isobutyl |
| tert-butyl | H | tert-butyl | Ethyl | methyl | ethyl |
| Methyl | H | methyl | Ethyl | methyl | n-propyl |
| Methyl | H | ethyl | Ethyl | methyl | isopropyl |
| Methyl | H | n-propyl | Ethyl | methyl | n-butyl |
| Methyl | H | isopropyl | Ethyl | methyl | isobutyl |
| Methyl | H | n-butyl | isopropyl | methyl | n-propyl |
| Methyl | H | isobutyl | isopropyl | methyl | isopropyl |
| Ethyl | H | ethyl | isopropyl | methyl | n-butyl |
| Ethyl | H | n-propyl | isopropyl | methyl | isobutyl |
| Ethyl | H | isopropyl | | | |
| Ethyl | H | n-butyl | | | |
| Ethyl | H | isobutyl | | | |
| isopropyl | H | n-propyl | | | |
| isopropyl | H | isopropyl | | | |
| isopropyl | H | n-butyl | | | |
| isopropyl | H | isobutyl | | | |

(in cases of the five-membered complex $R^2$ is not present)

In some embodiments, the chelate complex can include one or more ortho-ketophenol ligands, e.g., a complex having the formula:

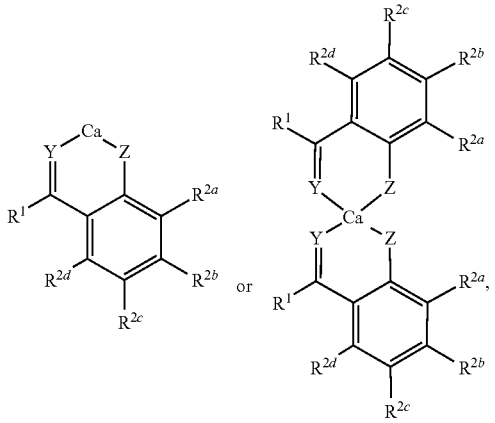

wherein $R^{2a}$, $R^{2b}$, $R^{2c}$, and $R^{2d}$ are independently selected from hydrogen; hydroxy; $C_{1-22}$alkyl, for instance, methyl, ethyl, n-propyl, isopropyl, n-butyl, iso-butyl, and tert-butyl pentyl, hexyl, heptyl, octyl, nonyl, decyl, undecyl, dodecyl; O—$C_{1-22}$alkyl, for instance methoxy, ethoxy, n-propoxy, isopropoxy, n-butoxy, iso-butoxy, or tert-butoxy; wherein any two or more of $R^1$, $R^{2a}$, $R^{2b}$, $R^{2c}$, and $R^{2d}$ can together form a ring. In certain embodiments, each of $R^{2a}$, $R^{2b}$, $R^{2c}$, and $R^{2d}$ can be hydrogen, while in others $R^{2a}$ can be hydroxyl. In some cases, the keto-phenol will be characterized where $R^1$ is methyl, ethyl, n-propyl, isopropyl, n-butyl, iso-butyl, and tert-butyl, methoxy, ethoxy, n-propoxy, isopropoxy, n-butoxy, iso-butoxy, or tert-butoxy. In certain preferred embodiments, Y and Z are each oxygen, however, as used herein, the term ortho-ketophenol also embraces compounds that do not include a keto (or aldehyde) group, for instance in which Y is $NR^{n1}$. In some instances, the keto-phenol ligand can be further substituted one time:

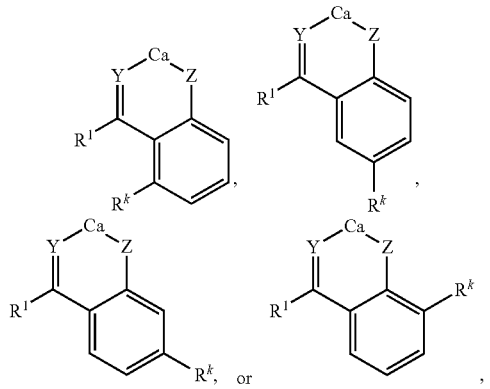

wherein $R^k$ is selected from hydroxyl, amino, $C_{1-22}$alkyl, for instance, methyl, ethyl, n-propyl, isopropyl, n-butyl, iso-butyl, and tert-butyl pentyl, hexyl, heptyl, octyl, nonyl, decyl, undecyl, dodecyl; and O—$C_{1-22}$alkyl, for instance methoxy, ethoxy, n-propoxy, isopropoxy, n-butoxy, iso-butoxy, or tert-butoxy.

In certain aspects, the complex can include a compound having the formula:

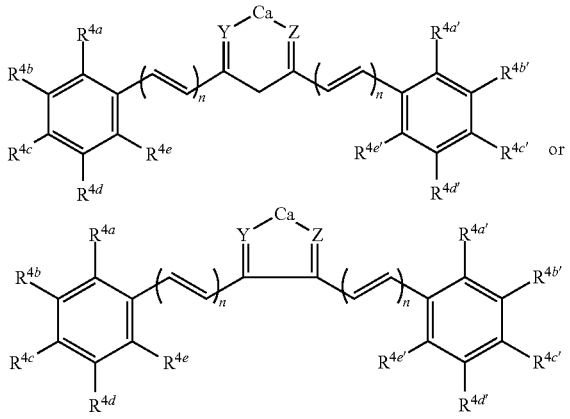

wherein n is 0, 1 or 2; and $R^{4a}$, $R^{4a'}$, $R^{4b}$, $R^{4b'}$, $R^{4c}$, $R^{4c'}$, $R^{4d}$, $R^{4d'}$, $R^{4e}$, and $R^{4e'}$ are independently selected from hydrogen; hydroxy; $C_{1-22}$alkyl, for instance, methyl, ethyl, n-propyl, isopropyl, n-butyl, iso-butyl, and tert-butyl, pentyl, hexyl, heptyl, octyl, nonyl, decyl, undecyl, dodecyl; $C_{1-22}$O-alkyl, for instance methoxy, ethoxy, n-propoxy, isopropoxy, n-butoxy, iso-butoxy, or tert-butoxy; wherein any two or more of $R^{4a}$, $R^{4a'}$, $R^{4b}$, $R^{4b'}$, $R^{4c}$, $R^{4c'}$, $R^{4d}$, $R^{4d'}$, $R^{4e}$, and $R^{4e'}$ can together form a ring. In certain embodiments, $R^{4c}$ and $R^{4c'}$ can each be either hydroxyl or amino; in further embodiments $R^{4b}$ and $R^{4b'}$ are each methoxy. In certain preferred embodiments, Y and Z are each oxygen.

In yet other aspects of the invention, Y can be $NR^{n1}$, wherein $R^{n1}$ is $C_{1-8}$alkyl, for instance, methyl, ethyl, n-propyl, isopropyl, n-butyl, iso-butyl, and tert-butyl; $C_{1-8}$O-alkyl, for instance methoxy, ethoxy, n-propoxy, isopropoxy, n-butoxy, iso-butoxy, or tert-butoxy. Such alkyl and alkoxy groups may be independently substituted as defined above. In some instances, $R^{n1}$ and $R^1$ can together form a ring, either a heterocyclyl or heteroaryl ring. In further embodiments, Z can be $NR^{n2}$, wherein $R^{n2}$ is $C_{1-8}$alkyl, for instance, methyl, ethyl, n-propyl, isopropyl, n-butyl, iso-butyl, and tert-butyl; $C_{1-8}$O-alkyl, for instance methoxy, ethoxy, n-propoxy, isopropoxy, n-butoxy, iso-butoxy, or tert-butoxy. Such alkyl and alkoxy groups may be independently substituted as defined above. In some instances, $R^{n2}$ and $R^3$ can together form a ring, either a heterocyclyl or heteroaryl ring.

In some cases, Y can be $NR^{n1}$, and Z can be $NR^{n2}$, wherein $R^{n1}$ is $C_{1-8}$alkyl, for instance, methyl, ethyl, n-propyl, isopropyl, n-butyl, iso-butyl, and tert-butyl, $R^{n2}$ is $C_{1-8}$alkyl, for instance, methyl, ethyl, n-propyl, isopropyl, n-butyl, iso-butyl, and tert-butyl, and $R^2$ is hydrogen or methyl.

In further aspects, the calcium complex can be a complex having the formula:

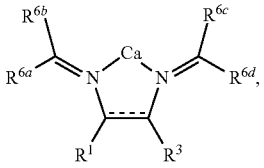

wherein $R^1$ and $R^3$ are as defined above, $R^{6a}$ and $R^{6d}$ are independently selected from hydrogen or $C_{1-8}$alkyl, and $R^{6b}$ and $R^{6c}$ are each

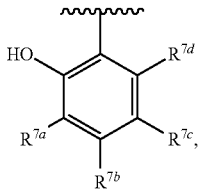

in which $R^{7a}$, $R^{7b}$, $R^{7c}$, and $R^{7d}$ are independently selected from hydrogen, hydroxyl, $C_{1-8}$alkyl, and O—$C_{1-8}$alkyl; wherein any two or more of $R^{7a}$, $R^{7b}$, $R^{7c}$, and $R^{7d}$ can together form a ring.

In certain aspects, the calcium chelate complex can include a compound having the formula:

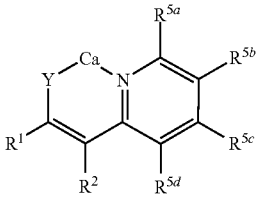

wherein $R^{5a}$, $R^{5b}$, $R^{5c}$, and $R^{5d}$ are independently selected from hydrogen; hydroxy; $C_{1-22}$alkyl, for instance, methyl, ethyl, n-propyl, isopropyl, n-butyl, iso-butyl, and tert-butyl, pentyl, hexyl, heptyl, octyl, nonyl, decyl, undecyl, dodecyl; $C_{1-22}$O-alkyl, for instance methoxy, ethoxy, n-propoxy, isopropoxy, n-butoxy, iso-butoxy, or tert-butoxy; wherein any two or more of $R^2$, $R^{5a}$, $R^{5b}$, $R^{5c}$, and $R^{5d}$ can together form a ring.

In some instances, the calcium cyclic chelate complex can be one of the following compounds:

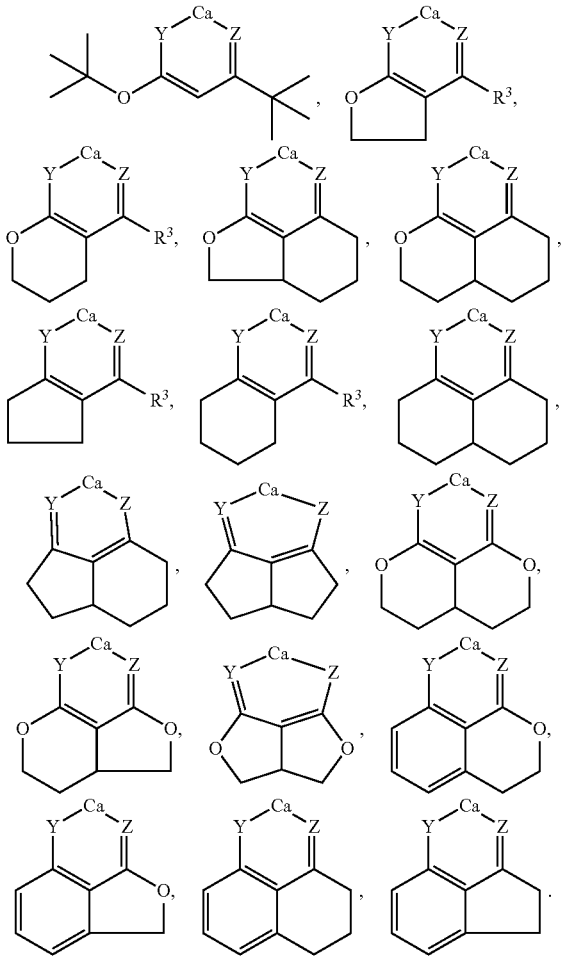

In some embodiments, the calcium cyclic chelate complex can be the reaction product of a calcium compound and at least one ligand compound having the formula:

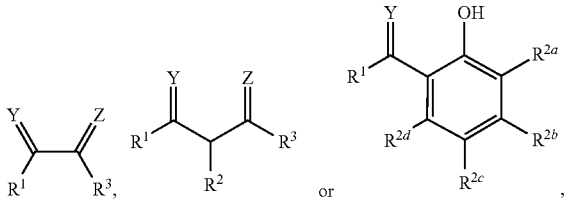

wherein

Y is selected from O, S, $NR^{n1}$;

Z is selected from O, S, $NR^{n2}$;

$R^1$, $R^2$, $R^3$, $R^{n1}$, and $R^{n2}$ are independently selected from $R^a$, $OR^b$, and $N(R^b)_2$; wherein $R^a$ is in each case independently selected from hydrogen, $C_{1-8}$alkyl, $C_{2-8}$alkenyl, $C_{2-8}$alkynyl, aryl, $C_{1-8}$heteroaryl, $C_{3-8}$cycloalkyl, or $C_{1-8}$heterocyclyl; $R^b$ is in each case independently selected from $C_{1-8}$alkyl, $C_{2-8}$alkenyl, $C_{2-8}$alkynyl, aryl, $C_{1-8}$heteroaryl, $C_{3-8}$cycloalkyl, or $C_{1-8}$heterocyclyl; and wherein any two or more of $R^1$, $R^2$, $R^3$, $R^{n1}$, and $R^{n2}$ can together form a ring.

Suitable calcium compounds include calcium hydroxide and calcium carbonate, either of which may be mixed with calcium oxide. In other instances, the calcium compound can be a salt like calcium chloride or calcium acetate. In such instances a base such as lithium hydroxide, lithium carbonate, sodium hydroxide, or sodium carbonate is employed to facilitate the reaction between the calcium compound and the ligand. The stochiometric ratio of calcium compound: ligand compound may be about 1:1, although in some embodiments there may be an excess of either calcium or compound. In other cases there can be about a 1:2 ratio of calcium compound:ligand, or a 1:3 ratio of calcium compound:ligand.

In some instances, the calcium cyclic chelate complex can be the reaction product of a calcium compound, for instance a calcium base, and a ligand compound having the formula:

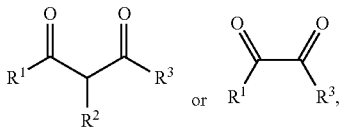

Suitable calcium compound:ligand molar ratios include 1:1, 1:2, and 1:3. In some embodiments, $R^1$ and $R^3$ are each $C_{1-8}$alkyl groups, and $R^2$ is hydrogen. Suitable $C_{1-8}$alkyl groups include methyl, ethyl, n-propyl, isopropyl, n-butyl, iso-butyl, and tert-butyl. Such $C_{1-8}$alkyl groups may be independently substituted one or more times. Suitable substituents include, but are not limited to, alkoxy, alkenyl, alkynyl, cycloalkyl, heterocycloalkyl, aryl, heteroaryl, aldehyde, amino, carboxylic acid, ester, ether, halide, hydroxy, ketone, nitro, silyl, sulfo-oxo, phosphine or thiol.

In some aspects of the invention, $R^1$ is O—$C_{1-8}$alkyl, for instance methoxy, ethoxy, n-propoxy, isopropoxy, n-butoxy, iso-butoxy, or tert-butoxy, and $R^3$ is $C_{1-8}$alkyl, for instance, methyl, ethyl, n-propyl, isopropyl, n-butyl, iso-butyl, and tert-butyl. Such O—$C_{1-8}$alkyl groups may be substituted as described for $C_{1-8}$alkyl groups. In some instances, $R^2$ is $C_{1-8}$alkyl, and may form a ring with either or both of $R^1$ and $R^3$. The following tables provide exemplary combinations of R groups that can be present in the ligand:

| $R^1$=$R^a$ $R^a$ | $R^2$=$R^a$ $R^a$ | $R^3$=$R^a$ $R^a$ | $R^1$=$OR^b$ $R^b$ | $R^2$=$R^a$ $R^a$ | $R^3$=$R^a$ $R^a$ |
|---|---|---|---|---|---|
| tert-butyl | H | methyl | tert-butyl | H | methyl |
| tert-butyl | H | ethyl | tert-butyl | H | ethyl |
| tert-butyl | H | n-propyl | tert-butyl | H | n-propyl |
| tert-butyl | H | isopropyl | tert-butyl | H | isopropyl |
| tert-butyl | H | n-butyl | tert-butyl | H | n-butyl |
| tert-butyl | H | isobutyl | tert-butyl | H | isobutyl |
| tert-butyl | H | tert-butyl | tert-butyl | H | tert-butyl |
| Methyl | H | methyl | Methyl | H | methyl |
| Methyl | H | ethyl | Methyl | H | ethyl |
| Methyl | H | n-propyl | Methyl | H | n-propyl |
| Methyl | H | isopropyl | Methyl | H | isopropyl |
| Methyl | H | n-butyl | Methyl | H | n-butyl |
| Methyl | H | isobutyl | Methyl | H | isobutyl |
| Ethyl | H | ethyl | Ethyl | H | ethyl |
| Ethyl | H | n-propyl | Ethyl | H | n-propyl |
| Ethyl | H | isopropyl | Ethyl | H | isopropyl |
| Ethyl | H | n-butyl | Ethyl | H | n-butyl |
| Ethyl | H | isobutyl | Ethyl | H | isobutyl |
| isopropyl | H | n-propyl | isopropyl | H | n-propyl |
| isopropyl | H | isopropyl | isopropyl | H | isopropyl |
| isopropyl | H | n-butyl | isopropyl | H | n-butyl |
| isopropyl | H | isobutyl | isopropyl | H | isobutyl |
| tert-butyl | H | methyl | tert-butyl | H | methyl |
| tert-butyl | H | ethyl | tert-butyl | H | ethyl |
| tert-butyl | H | n-propyl | tert-butyl | H | n-propyl |
| tert-butyl | H | isopropyl | tert-butyl | H | isopropyl |
| tert-butyl | H | n-butyl | tert-butyl | H | n-butyl |
| tert-butyl | H | isobutyl | tert-butyl | H | isobutyl |
| tert-butyl | H | tert-butyl | tert-butyl | H | tert-butyl |
| Methyl | methyl | methyl | Methyl | methyl | methyl |
| Methyl | methyl | ethyl | Methyl | methyl | ethyl |
| Methyl | methyl | n-propyl | Methyl | methyl | n-propyl |
| Methyl | methyl | isopropyl | Methyl | methyl | isopropyl |
| Methyl | methyl | n-butyl | Methyl | methyl | n-butyl |
| Methyl | methyl | isobutyl | Methyl | methyl | isobutyl |
| Ethyl | methyl | ethyl | Ethyl | methyl | ethyl |
| Ethyl | methyl | n-propyl | Ethyl | methyl | n-propyl |
| Ethyl | methyl | isopropyl | Ethyl | methyl | isopropyl |
| Ethyl | methyl | n-butyl | Ethyl | methyl | n-butyl |
| Ethyl | methyl | isobutyl | Ethyl | methyl | isobutyl |
| isopropyl | methyl | n-propyl | isopropyl | methyl | n-propyl |
| isopropyl | methyl | isopropyl | isopropyl | methyl | isopropyl |
| isopropyl | methyl | n-butyl | isopropyl | methyl | n-butyl |
| isopropyl | methyl | isobutyl | isopropyl | methyl | isobutyl |

-continued

| $R^1$=$OR^b$ $R^b$ | $R^2$=$R^a$ $R^a$ | $R^3$=$OR^b$ $R^b$ | $R^1$=$OR^b$ $R^b$ | $R^2$=$OR^b$ $OR^b$ | $R^3$=$R^a$ $R^a$ |
|---|---|---|---|---|---|
| tert-butyl | H | methyl | Methyl | methyl | methyl |
| tert-butyl | H | ethyl | Methyl | methyl | ethyl |
| tert-butyl | H | n-propyl | Methyl | methyl | n-propyl |
| tert-butyl | H | isopropyl | Methyl | methyl | isopropyl |
| tert-butyl | H | n-butyl | Methyl | methyl | n-butyl |
| tert-butyl | H | isobutyl | Methyl | methyl | isobutyl |
| tert-butyl | H | tert-butyl | Ethyl | methyl | ethyl |
| Methyl | H | methyl | Ethyl | methyl | n-propyl |
| Methyl | H | ethyl | Ethyl | methyl | isopropyl |
| Methyl | H | n-propyl | Ethyl | methyl | n-butyl |
| Methyl | H | isopropyl | Ethyl | methyl | isobutyl |
| Methyl | H | n-butyl | isopropyl | methyl | n-propyl |
| Methyl | H | isobutyl | isopropyl | methyl | isopropyl |
| Ethyl | H | ethyl | isopropyl | methyl | n-butyl |
| Ethyl | H | n-propyl | isopropyl | methyl | isobutyl |
| Ethyl | H | isopropyl | | | |
| Ethyl | H | n-butyl | | | |
| Ethyl | H | isobutyl | | | |
| isopropyl | H | n-propyl | | | |
| isopropyl | H | isopropyl | | | |
| isopropyl | H | n-butyl | | | |
| isopropyl | H | isobutyl | | | |

(in cases of the five-membered complex, $R^2$ is not present)

In some instances, the calcium cyclic chelate complex can be the reaction product of a calcium compound, for instance a calcium base, and an ortho-ketophenol having the formula:

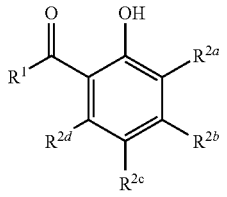

wherein $R^{2a}$, $R^{2b}$, $R^{2c}$, and $R^{2d}$ are independently selected from hydrogen; hydroxy; $C_{1-22}$alkyl, for instance, methyl, ethyl, n-propyl, isopropyl, n-butyl, iso-butyl, and tert-butyl pentyl, hexyl, heptyl, octyl, nonyl, decyl, undecyl, dodecyl; O—$C_{1-22}$alkyl, for instance methoxy, ethoxy, n-propoxy, isopropoxy, n-butoxy, iso-butoxy, or tert-butoxy; wherein any two or more of $R^1$, $R^{2a}$, $R^{2b}$, $R^{2c}$, and $R^{2d}$ can together form a ring. In certain embodiments, each of $R^{2a}$, $R^{2b}$, $R^{2c}$, and $R^{2d}$ can be hydrogen, while in others $R^{2a}$ can be hydroxyl. In some cases, the ortho ketophenol will be characterized where $R^1$ is methyl, ethyl, n-propyl, isopropyl, n-butyl, iso-butyl, and tert-butyl, methoxy, ethoxy, n-propoxy, isopropoxy, n-butoxy, iso-butoxy, or tert-butoxy. In certain preferred embodiments, Y and Z are each oxygen, however, the term ortho-ketophenol also embraces compounds that do not include a keto (or aldehyde) group, for instance in which Y is $NR^{n1}$. In some instances, the ortho-ketophenol can include a trisubstituted phenyl ring:

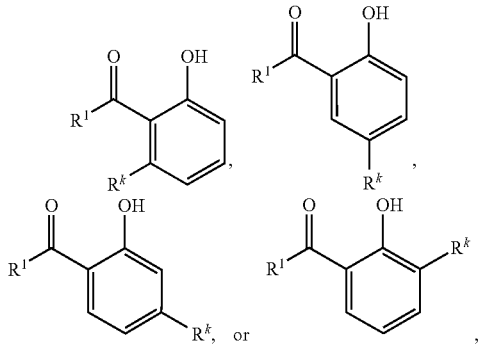

wherein $R^k$ is selected from hydroxyl, amino, $C_{1-22}$alkyl, for instance, methyl, ethyl, n-propyl, isopropyl, n-butyl, iso-butyl, and tert-butyl pentyl, hexyl, heptyl, octyl, nonyl, decyl, undecyl, dodecyl; and O—$C_{1-22}$alkyl, for instance methoxy, ethoxy, n-propoxy, isopropoxy, n-butoxy, iso-butoxy, or tert-butoxy.

In some aspects, the calcium chelate can be the reaction product of a calcium compound, for instance a calcium base, and a ligand compound having the formula:

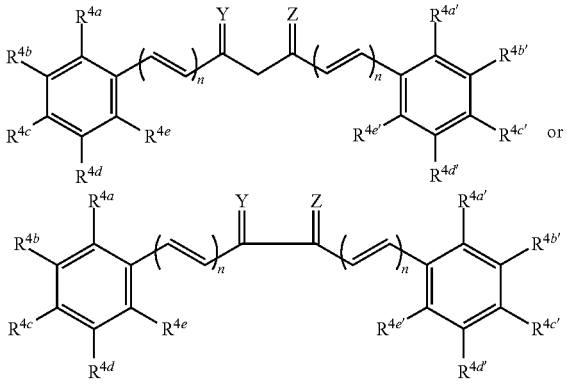

wherein n is 0, 1 or 2; and $R^{4a}$, $R^{4a'}$, $R^{4b}$, $R^{4b'}$, $R^{4c}$, $R^{4c'}$, $R^{4d}$, $R^{4d'}$, $R^{4e}$, and $R^{4e'}$ are independently selected from hydrogen; hydroxy; $C_{1-22}$alkyl, for instance, methyl, ethyl, n-propyl, isopropyl, n-butyl, iso-butyl, and tert-butyl, pentyl, hexyl, heptyl, octyl, nonyl, decyl, undecyl, dodecyl; $C_{1-22}$O-alkyl, for instance methoxy, ethoxy, n-propoxy, isopropoxy, n-butoxy, iso-butoxy, or tert-butoxy; wherein any two or more of $R^{4a}$, $R^{4a'}$, $R^{4b}$, $R^{4b'}$, $R^{4c}$, $R^{4c'}$, $R^{4d}$, $R^{4d'}$, $R^{4e}$, and $R^{4e'}$ can together form a ring. In certain embodiments, $R^{4c}$ and $R^{4c'}$ can each be either hydroxyl or amino; in further embodiments $R^{4b}$ and $R^{4b'}$ are each methoxy. In certain preferred embodiments, Y and Z are each oxygen.

In further embodiments, the calcium chelate can be the reaction product of a calcium compound, for instance a calcium base, and a salen compound having the formula:

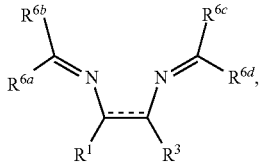

wherein $R^1$ and $R^3$ are as defined above, $R^{6a}$ and $R^{6d}$ are independently selected from hydrogen or $C_{1-8}$alkyl, and $R^{6b}$ and $R^{6c}$ are each

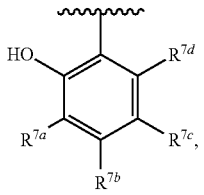

in which $R^{7a}$, $R^{7b}$, $R^{7c}$, and $R^{7d}$ are independently selected from hydrogen, hydroxyl, $C_{1-8}$alkyl, and O—$C_{1-8}$alkyl; wherein any two or more of $R^{7a}$, $R^{7b}$, $R^{7c}$, and $R^{7d}$ can together form a ring.

In other embodiments, the calcium chelate complex is the reaction product of a calcium compound, for instance a calcium base, and a ligand compound having the formula:

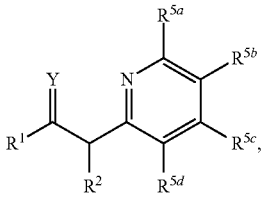

wherein $R^{5a}$, $R^{5b}$, $R^{5c}$, and $R^{5d}$ are independently selected from hydrogen; hydroxy; $C_{1-22}$alkyl, for instance, methyl, ethyl, n-propyl, isopropyl, n-butyl, iso-butyl, and tert-butyl, pentyl, hexyl, heptyl, octyl, nonyl, decyl, undecyl, dodecyl; $C_{1-22}$O-alkyl, for instance methoxy, ethoxy, n-propoxy, isopropoxy, n-butoxy, iso-butoxy, or tert-butoxy; wherein any two or more of $R^2$, $R^{5a}$, $R^{5b}$, $R^{5c}$, and $R^{5d}$ can together form a ring.

In further embodiments, the calcium chelate can be the reaction product of a calcium compound, for instance a calcium base, and one of the following ligand compounds:

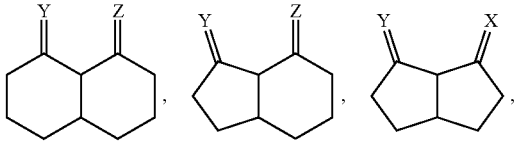

-continued

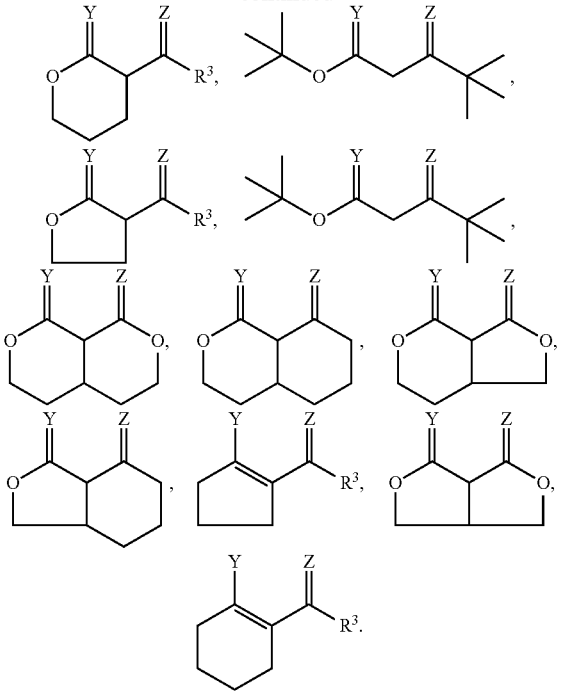

Generally, the amount of the calcium cyclic chelate complex can be from about 0.001 wt. % to about 25 wt. %, from about 0.05 wt. % to about 20 wt. %, or from about 0.1 wt. % to about 15 wt. %, or from about 0.1 wt. % to about 5 wt. %, from about, 0.1 wt. % to about 4.0 wt. %, based on the total weight of the lubricating oil composition.

In an aspect, the present disclosure provides a lubricating engine oil composition for a direct injected, boosted, spark ignited internal combustion engine comprising at least one calcium chelate complex. In one embodiment, the amount of metal from the at least one calcium cyclic chelate complex is from about 100 to about 3000 ppm, from about 200 to about 3000 ppm, or from about 250 to about 2500 ppm, from about 300 to about 2500 ppm, from about 350 to about 2500 ppm, from about 400 ppm to about 2500 ppm, from about 500 to about 2500 ppm, from about 600 to about 2500 ppm, from about 700 to about 2500 ppm, from about 700 to about 2000 ppm, from about 700 to about 1500 ppm. In one embodiment, the amount of metal from the calcium cyclic chelate complex is no more than about 2000 ppm or no more than about 1500 ppm.

In one embodiment, the lubricating compositions can include conventional lubricating oil detergent additives which contain magnesium and/or calcium. In one embodiment the calcium detergent(s) can be added in an amount sufficient to provide the lubricating oil composition from 0 to about 2400 ppm of calcium detergent(s), from 0 to about 2200 ppm of calcium detergent(s), from 100 to about 2000 ppm of calcium detergent(s), from 200 to about 1800 ppm of calcium detergent(s), or from about 100 to about 1800 ppm, or from about 200 to about 1500 ppm, or from about 300 to about 1400 ppm, or from about 400 to about 1400 ppm, of calcium detergent(s) in the lubricating oil composition. In one embodiment the magnesium detergent(s) can be added in an amount sufficient to provide the lubricating oil composition from about 100 to about 1000 ppm of magnesium metal, or from about 100 to about 600 ppm, or from about 100 to about 500 ppm, or from about 200 to about 500 ppm of magnesium metal in the lubricating oil composition.

In one embodiment, the lubricating compositions can include conventional lubricating oil detergent additives which contain lithium. In one embodiment the lithium detergent(s) can be added in an amount sufficient to provide the lubricating oil composition from 0 to about 2400 ppm of lithium metal, from 0 to about 2200 ppm of lithium metal, from 100 to about 2000 ppm of lithium metal, from 200 to about 1800 ppm of lithium metal, or from about 100 to about 1800 ppm, or from about 200 to about 1500 ppm, or from about 300 to about 1400 ppm, or from about 400 to about 1400 ppm, of lithium metal in the lubricating oil composition.

In one embodiment, the lubricating compositions can include conventional lubricating oil detergent additives which contain sodium. In one embodiment the sodium detergent(s) can be added in an amount sufficient to provide the lubricating oil composition from 0 to about 2400 ppm of sodium metal, from 0 to about 2200 ppm of sodium metal, from 100 to about 2000 ppm of sodium metal, from 200 to about 1800 ppm of sodium metal, or from about 100 to about 1800 ppm, or from about 200 to about 1500 ppm, or from about 300 to about 1400 ppm, or from about 400 to about 1400 ppm, of sodium metal in the lubricating oil composition.

In one embodiment, the lubricating compositions can include conventional lubricating oil detergent additives which contain potassium. In one embodiment the potassium detergent(s) can be added in an amount sufficient to provide the lubricating oil composition from 0 to about 2400 ppm of potassium metal, from 0 to about 2200 ppm of potassium metal, from 100 to about 2000 ppm of potassium metal, from 200 to about 1800 ppm of potassium metal, or from about 100 to about 1800 ppm, or from about 200 to about 1500 ppm, or from about 300 to about 1400 ppm, or from about 400 to about 1400 ppm, of potassium metal in the lubricating oil composition.

In one embodiment, a lubricating engine oil composition including a lubricating oil base stock as a major component and at least one calcium cyclic chelate complex can be added to an engine. In some embodiments, the engine exhibits greater than 50% reduced low speed pre-ignition, based on normalized low speed pre-ignition (LSPI) counts per 100,000 engine cycles, engine operation at between 500 and 3,000 revolutions per minute and brake mean effective pressure (BMEP) between 10 and 30 bar, as compared to low speed pre-ignition performance achieved in an engine using a lubricating oil that does not comprise the at least one calcium cyclic chelate complex.

In one aspect, the disclosure provides a lubricating engine oil composition for use in a down-sized boosted engine comprising a lubricating oil base stock as a major component; and at least one calcium cyclic chelate complex as a minor component; where the downsized engine ranges from about 0.5 to about 3.6 liters, from about 0.5 to about 3.0 liters, from about 0.8 to about 3.0 liters, from about 0.5 to about 2.0 liters, or from about 1.0 to about 2.0 liters.

The engine can have two, three, four, five or six cylinders.

In an aspect, the present disclosure provides the use of a at least one calcium cyclic chelate complex for preventing or reducing low speed pre-ignition in a direct injected, boosted, spark ignited internal combustion engine.

Lubricating Oil Additives

In addition to the calcium cyclic chelate complexes described herein, the lubricating oil composition can comprise additional lubricating oil additives.

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, anti-wear agents, metal detergents, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

The lubricating oil composition of the present invention can contain one or more detergents. Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts. A large amount of a metal base may be incorporated by reacting excess metal compound (e.g., an oxide or hydroxide) with an acidic gas (e.g., carbon dioxide).

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium.

The lubricating oil composition of the present invention can contain one or more anti-wear agents that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo and the like) salts of dithiophosphates, metal (e.g., Zn, Pb, Sb, Mo and the like) salts of dithiocarbamates, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition.

In certain embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

The amount of the dihydrocarbyl dithiophosphate metal salt including the zinc dialkyl dithiophosphate salts in the lubricating oil composition disclosed herein is measured by its phosphorus content. In some embodiments, the phosphorus content of the lubricating oil composition disclosed herein is from about 0.01 wt. % to about 0.14 wt. %, based on the total weight of the lubricating oil composition.

The lubricating oil composition of the present invention can contain one or more friction modifiers that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, or a $C_6$ to $C_{24}$, or a $C_6$ to $C_{20}$, fatty acid ester and a nitrogen-containing compound selected from the group consisting of ammonia, and an alkanolamine and the like and mixtures thereof. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition.

The lubricating oil composition of the disclosure can contain a molybdenum-containing friction modifier. The molybdenum-containing friction modifier can be any one of the known molybdenum-containing friction modifiers or the known molybdenum-containing friction modifier compositions.

Preferred molybdenum-containing friction modifiers include, for example, sulfurized oxymolybdenum dithiocarbamate, sulfurized oxymolybdenum dithiophosphate, amine-molybdenum complex compound, oxymolybdenum diethylate amide, and oxymolybdenum monoglyceride. Most preferred is a molybdenum dithiocarbamate friction modifier.

The lubricating oil composition of the invention generally contains the molybdenum-containing friction modifier in an amount of 0.01 to 0.15 wt. % in terms of the molybdenum content.

The lubricating oil composition of the invention preferably contains an organic oxidation inhibitor in an amount of 0.01-5 wt. %, preferably 0.1-3 wt. %. The oxidation inhibitor can be a hindered phenol oxidation inhibitor or a diarylamine oxidation inhibitor. The diarylamine oxidation inhibitor is advantageous in giving a base number originating from the nitrogen atoms. The hindered phenol oxidation inhibitor is advantageous in producing no NOx gas.

Examples of the hindered phenol oxidation inhibitors include 2,6-di-t-butyl-p-cresol, 4,4'-methylenebis(2,6-di-t-butylphenol), 4,4'-methylenebis(6-t-butyl-o-cresol), 4,4'-isopropylidenebis(2,6-di-t-butylphenol), 4,4'-bis(2,6-di-t-butylphenol), 2,2'-methylenebis(4-methyl-6-t-butylphenol), 4,4'-thiobis(2-methyl-6-t-butylphenol), 2,2-thio-diethylenebis[3-(3,5-di-t-butyl-4-hydroxyphenyl)propionate], octyl 3-(3,5-di-t-butyl-4-hydroxyphenyl)propionate, octadecyl 3-(3,5-di-t-butyl-4-hydroxyphenyl)propionate, and octyl 3-(3,54-butyl-4-hydroxy-3-methylphenyl)propionate, and commercial products such as, but not limited to, Irganox L135® (BASF), Naugalube 531® (Chemtura), and Ethanox 376® (SI Group).

Examples of the diarylamine oxidation inhibitors include alkyldiphenylamine having a mixture of alkyl groups of 3 to 9 carbon atoms, p,p-dioctyldiphenylamine, phenyl-naphthylamine, phenyl-naphthylamine, alkylated-naphthylamine, and alkylated phenyl-naphthylamine. The diarylamine oxidation inhibitors can have from 1 to 3 alkyl groups.

Each of the hindered phenol oxidation inhibitor and diarylamine oxidation inhibitor can be employed alone or in combination. If desired, other oil soluble oxidation inhibitors can be employed in combination with the above-mentioned oxidation inhibitor(s).

The lubricating oil composition of the invention may further contain an oxymolybdenum complex of succinimide, particularly a sulfur-containing oxymolybdenum complex of succinimide. The sulfur-containing oxymolybdenum complex of succinimide can provide increased oxidation inhibition when it is employed in combination with the above-mentioned phenolic or amine oxidation inhibitors.

In the preparation of lubricating oil formulations it is common practice to introduce the additives in the form of 10 to 80 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Processes of Preparing Lubricating Oil Compositions

The lubricating oil compositions disclosed herein can be prepared by any method known to a person of ordinary skill in the art for making lubricating oils. In some embodiments, the base oil can be blended or mixed with the calcium cyclic chelate complex. Optionally, one or more other additives in additional to the calcium cyclic chelate complex can be added. The calcium cyclic chelate complex and the optional additives may be added to the base oil individually or simultaneously. In some embodiments, the calcium cyclic chelate complex and the optional additives are added to the base oil individually in one or more additions and the additions may be in any order. In other embodiments, the calcium cyclic chelate complex and the additives are added to the base oil simultaneously, optionally in the form of an additive concentrate. In some embodiments, the solubilizing of the calcium cyclic chelate complex or any solid additives in the base oil may be assisted by heating the mixture to a temperature from about 25° C. to about 200° C., from about 50° C. to about 150° C. or from about 75° C. to about 125° C.

Any mixing or dispersing equipment known to a person of ordinary skill in the art may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., Gaulin homogenizers and Rannie homogenizers), a mill (e.g., colloid mill, ball mill and sand mill) or any other mixing or dispersing equipment known in the art.

Application of the Lubricating Oil Compositions

The lubricating oil composition disclosed herein may be suitable for use as motor oils (that is, engine oils or crankcase oils), in a spark-ignited internal combustion engine, particularly a direct injected, boosted, engine that is susceptible to low speed pre-ignition.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

EXAMPLES

The following examples are for the purpose of illustration of the invention only and are not intended to limit the scope of the present invention in any manner whatsoever.

The test compounds were blended in lube oil and their capacity for reducing LSPI events were determined using the test method described below.

Low Speed Pre-ignition events were measured in a Ford 2.0 L Ecoboost engine. This engine is a turbocharged gasoline direct injection (GDI) engine. The Ford Ecoboost engine is operated in four-roughly 4 hour iterations. The engine is operated at 1750 rpm and 1.7 MPa break mean effective pressure (BMEP) with an oil sump temperature of 95° C. The engine is run for 175,000 combustion cycles in each stage, and LSPI events are counted.

LSPI events are determined by monitoring peak cylinder pressure (PP) and mass fraction burn (MFB) of the fuel charge in the cylinder. When either or both criteria are met, it can be said that an LSPI event has occurred. The threshold for peak cylinder pressure varies by test, but is typically 4-5 standard deviations above the average cylinder pressure. Likewise, the MFB threshold is typically 4-5 standard deviations earlier than the average MFB (represented in crank angle degrees). LSPI events can be reported as average events per test, events per 100,000 combustion cycles, events per cycle, and/or combustion cycles per event. The results for this test is shown below.

An additive associated with a test lubricant that reduces the LSPI frequency, when compared to the corresponding baseline lubricant, is considered an additive that mitigates LSPI frequency. The test results are set forth in Table 1.

Baseline Formulation

The baseline formulation contained a Group 2 base oil, a mixture of primary and secondary dialkyl zinc dithiophosphates in an amount to provide 741-814 ppm phosphorus to the lubricating oil composition, a mixture of polyisobutenyl succinimide dispersants (borated and ethylene carbonate post-treated), a molybdenum succinimide complex, an alkylated diphenylamine antioxidant, a borated friction modifier, a foam inhibitor, a pour point depressant, and an olefin copolymer viscosity index improver.

The lubricating oil compositions were blended into a 5W-30 viscosity grade oil.

(Calcium 2,2,6,6-tetramethyl-3,5-dioxoheptan-4-ide)

Calcium 2,2,6,6-tetramethyl-3,5-dioxoheptan-4-ide) was a commercially available from Millipore Sigma®.

Example 1

A lubricating oil composition was prepared by adding about 1120 ppm of calcium from the calcium 2,2,6,6-tetramethyl-3,5-dioxoheptan-4-ide and about 1120 ppm of calcium from a combination of overbased Ca sulfonate and phenate detergents to the baseline formulation.

Comparative Example 1

A lubricating oil composition was prepared by adding 2255 ppm of calcium from a combination of overbased Ca sulfonate and phenate detergents to the baseline formulation.

Comparative Example 2

A lubricating oil composition was prepared by adding about 1000 ppm of calcium from a combination of overbased Ca sulfonate and phenate detergents to the baseline formulation.

Comparative Example 3

A lubricating oil composition was prepared by adding about 1120 ppm of calcium from calcium oleate combination of overbased Ca sulfonate and phenate detergents to the baseline formulation.

TABLE 1

LSPI Test Results in Ford LSPI Test

| | Ex. 1 | Comp. Ex. 1 | % Reduction in LSPI activity |
|---|---|---|---|
| Ca (ppm) from compound A | 1120 | 0 | |
| Ca (ppm) total | 1120 | 2255 | |
| Average Events | 7.4 | 19.25 | 62 |
| Average Events > 90 bar | 1.75 | 13.25 | 87 |
| Average Events > 100 bar | 1.5 | 10.75 | 86 |
| Average Events > 110 bar | 1.5 | 9.0 | 83 |
| Average Events > 120 bar | 1.5 | 8.25 | 82 |

| | Ex. 1 | Comp. Ex. 3 | % Reduction in LSPI activity |
|---|---|---|---|
| Ca (ppm) from compound A | 1120 | 0 | |
| Ca (ppm) from Ca oleate | 0 | 1120 | |
| Ca (ppm) total | 1120 | 2331 | |
| Average Events | 7.4 | 20.98 | 65 |
| Average Events > 90 bar | 1.75 | 13.75 | 87 |
| Average Events > 100 bar | 1.5 | 10.5 | 86 |
| Average Events > 110 bar | 1.5 | 8.5 | 82 |
| Average Events > 120 bar | 1.5 | 6.25 | 76 |

*Counts all cycles of LSPI where both MFB02 and Peak Pressure Requirements are met The data shows that Applicant's inventive examples comprising a calcium chelate complex, for instance a calcium chelate of a 1,3-dicarbonyl compound, 1,3-ketophenol, 1,3-diimine, or phenol of the disclosure provided significantly better LSPI performance both in terms of number of events and also the number of severe LSPI events than the comparative examples which did not contain the calcium cyclic chelate complex, for instance a calcium chelate of a 1,3-dicarbonyl compound, ortho-ketophenol, 1,3-diimine, mixed chelate or combination thereof in the Ford engines. Severity is reduced by decreasing the number of high pressure events (i.e. over 120 bar) that can damage an engine.

Even more impressive about the result achieved with Example 1 was that this calcium compound improved LSPI performance when it has been shown that calcium is very detrimental to LSPI.

Ball Rust Test (BRT)—ASTM D6557

The BRT is a bench screening tool to evaluate the anti-rust ability of fluid lubrications. This method is suitable for the evaluation of automotive engine oils under low-temperature, acidic service conditions. Multiple test tubes each containing test oil and a specimen—a carbon steel ball, 5.6 mm (AISI 1040)—are placed in a test tube rack that is attached to a mechanical shaker. The shaker speed is set to 300 r/min and the temperature is controlled to 48+/−0.1° C. Air and an acidic solution are continuously fed into each test tube over an 18 h period to create a corrosive environment. The carbon steel balls are then removed, rinsed, and analyzed by an optical imaging system that quantifies the antirust capability of each test oil by measuring the gray value of each carbon steel ball relative to a calibration reference carbon steel ball. A copy of this test method can be obtained from ASTM International at 100 Barr Harbor Drive, PO Box 0700, West Conshohocken, Pa. 19428-2959 and is herein incorporated for all purposes.

| | Ex. 1 | Comp. Ex. 1 | Comp. Ex. 2 |
|---|---|---|---|
| Ca (ppm) from compound A | 1120 | 0 | 0 |
| Ca (ppm) total | 1120 | 2255 | 1000 |
| BRT Result (average gray value) | 126 | 125 (average) | 46 |
| TBN (ASTM 2896) | 9.1 | 9.1 | 5.2 (predicted) |
| TBN (ASTM 4739) | 7.2 | 6.6 | Not measured |

The basicity of a lubricating oil composition can be determined by acid titration. The resulting neutralization number is expressed as total base number, or TBN, and can be measured using various methods. Two methods conventionally selected are ASTM D4739 (potentiometric hydrochloric acid titration) and ASTM D2896 (potentiometric perchloric acid titration). ASTM D2896 uses a stronger acid than ASTM D4739 and a more polar solvent system. The combination of the stronger acid and more polar solvent results in a more repeatable method that measures the presence of both strong and weak bases. The TBN value as determined by ASTM D2896 is often used in fresh oil specifications. The ASTM D4739 method is favored in engine tests and with used oils to measure TBN depletion/retention. In general, the ASTM D4739 method results in a lower measured TBN value because only stronger basic species are titrated. A copy of this test method can be obtained from ASTM International at 100 Barr Harbor Drive, PO Box 0700, West Conshohocken, Pa. 19428-2959 and is herein incorporated for all purposes.

The engine oil compositions have outstanding performance in the ball rust test (BRT) of ASTM D6557. Preferably, the average gray value is at least 100, or at least 110, or at least 120. The calcium compound of Example 1 also brings more TBN to the lubricating oil than a conventional detergent.

The compositions and methods of the appended claims are not limited in scope by the specific compositions and methods described herein, which are intended as illustrations of a few aspects of the claims and any compositions and methods that are functionally equivalent are intended to fall within the scope of the claims. Various modifications of the compositions and methods in addition to those shown and described herein are intended to fall within the scope of the appended claims. Further, while only certain representative compositions and method steps disclosed herein are specifically described, other combinations of the compositions and method steps also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed. Other than in the examples, or where otherwise noted, all numbers expressing quantities of ingredients, reaction conditions, and so forth used in the specification and claims are to be understood at the very least, and not as an attempt to limit the application of the doctrine of equivalents to the scope of the claims, to be construed in light of the number of significant digits and ordinary rounding approaches.

What is claimed is:

1. A lubricating composition comprising a base oil and at least one cyclic calcium chelate complex, wherein the calcium chelate complex comprises a complex having the formula:

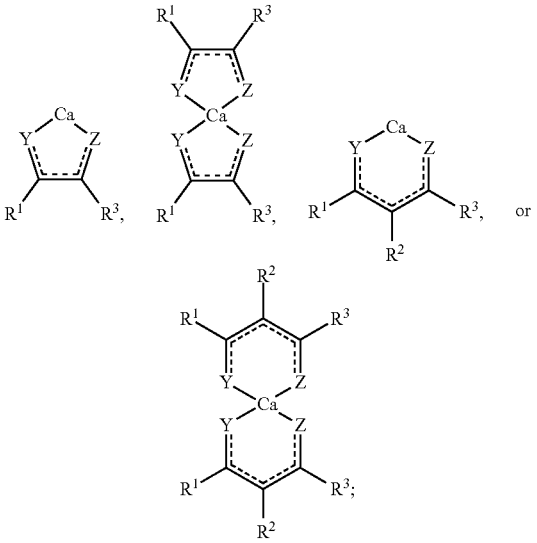

wherein:

‖ independently represents a single or double bond, provided that valence is satisfied;

Y is selected from O, S, $NR^{n1}$;

Z is selected from O, S, or $NR^{n2}$; and $R^1$, $R^2$, $R^3$, $R^{n1}$, and $R^{n2}$ are independently selected from $R^a$, $OR^b$, and $N(R^b)_2$;

wherein $R^a$ is in each case independently selected from hydrogen, $C_{1-8}$alkyl, $C_{2-8}$ alkenyl, $C_{2-8}$ alkynyl, aryl, $C_{1-8}$heteroaryl, $C_{3-8}$ cycloalkyl, or $C_{1-8}$ heterocyclyl;

$R^b$ is in each case independently selected from $C_{1-8}$ alkyl, $C_{2-8}$ alkenyl, $C_{2-8}$ alkynyl, aryl, $C_{1-8}$ heteroaryl, $C_{3-8}$ cycloalkyl, or $C_{1-8}$ heterocyclil; and wherein any two or more of $R^1$, $R^2$, $R^3$, $R^{n1}$, and $R^{n2}$ can together form a ring.

2. The lubricating composition according to claim 1, wherein the calcium chelate complex has the formula:

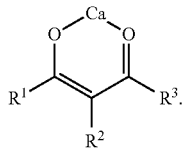

3. The lubricating composition according to claim 1, wherein $R^1$ is selected from methoxy, ethoxy, n-propoxy, isopropoxy, n-butoxy, iso-butoxy, tert-butoxy, methyl, ethyl, n-propyl, isopropyl, n-butyl, iso-butyl, and tert-butyl.

4. The lubricating composition according to claim 1, wherein $R^3$ is selected from methoxy, ethoxy, n-propoxy, isopropoxy, n-butoxy, iso-butoxy, tert-butoxy, methyl, ethyl, n-propyl, isopropyl, n-butyl, iso-butyl, and tert-butyl.

5. The lubricating composition according to claim 1, wherein $R^2$ is selected from hydrogen, methoxy, ethoxy, n-propoxy, isopropoxy, n-butoxy, iso-butoxy, tert-butoxy, methyl, ethyl, n-propyl, isopropyl, n-butyl, iso-butyl, and tert-butyl.

6. The lubricating composition according to claim 1, wherein $R^1$ and $R^2$ together form a ring.

7. The lubricating composition according to claim 1, wherein $R^2$ and $R^3$ together form a ring.

8. The lubricating composition according to claim 1, wherein $R^1$, $R^2$ and $R^3$ together form a polycyclic ring system.

9. The lubricating composition according to claim 1, wherein the calcium chelate complex comprises:

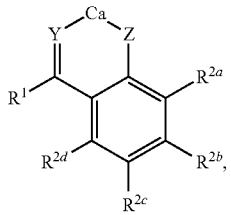

wherein $R^{2a}$, $R^{2b}$, $R^{2c}$, and $R^{2d}$ are independently selected from hydrogen; hydroxy; $C_{1-22}$alkyl; and O—$C_{1-22}$alkyl wherein any two or more of $R^1$, $R^{2a}$, $R^{2b}$, $R^{2c}$, and $R^{2d}$ can together form a ring.

10. The lubricating composition according to claim 9, wherein the calcium chelate complex comprises:

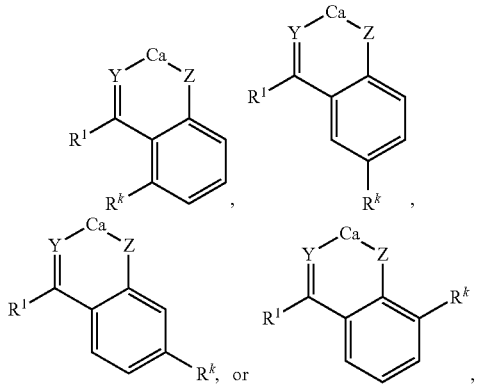

wherein $R^k$ is selected from hydroxyl, amino, $C_{1-22}$alkyl, for instance, methyl, ethyl, n-propyl, isopropyl, n-butyl, iso-butyl, and tert-butyl pentyl, hexyl, heptyl, octyl, nonyl, decyl, undecyl, dodecyl; and O—$C_{1-22}$alkyl, for instance methoxy, ethoxy, n-propoxy, isopropoxy, n-butoxy, iso-butoxy, or tert-butoxy.

11. The lubricating composition according to claim 1, wherein the calcium chelate complex has the formula:

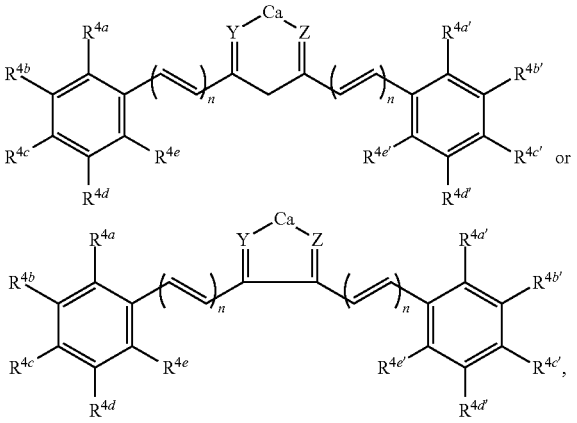

wherein n is 0, 1 or 2; and $R^{4a}$, $R^{4a'}$, $R^{4b}$, $R^{4b'}$, $R^{4c}$, $R^{4c'}$, $R^{4d}$, $R^{4d'}$, $R^{4e}$, and $R^{4e'}$ are independently selected from hydrogen; hydroxy; $C_{1-22}$alkyl, for instance, methyl, ethyl, n-propyl, isopropyl, n-butyl, iso-butyl, and tert-butyl, pentyl, hexyl, heptyl, octyl, nonyl, decyl, undecyl, dodecyl; $C_{1-22}$O-alkyl, for instance methoxy, ethoxy, n-propoxy, isopropoxy, n-butoxy, iso-butoxy, or tert-butoxy; wherein any two or more of $R^{4a}$, $R^{4a'}$, $R^{4b}$, $R^{4b'}$, $R^{4c}$, $R^{4c'}$, $R^{4d}$, $R^{4d'}$, $R^{4e}$, and $R^{4e'}$ can together form a ring, preferably $R^{4c}$ and $R^{4c'}$ are either hydroxyl or amino, preferably $R^{4b}$ and $R^{4b'}$ are each methoxy.

12. The lubricating composition according to claim 1, wherein Y is $NR^{n1}$, and $R^{n1}$ is $C_{1-8}$alkyl, for instance, methyl, ethyl, n-propyl, isopropyl, n-butyl, iso-butyl, and tert-butyl; $C_{1-8}$O-alkyl, for instance methoxy, ethoxy, n-propoxy, isopropoxy, n-butoxy, iso-butoxy, or tert-butoxy.

13. The lubricating composition according to claim 1, wherein Z is $NR^{n2}$, and $R^{n2}$ is $C_{1-8}$alkyl, for instance, methyl, ethyl, n-propyl, isopropyl, n-butyl, iso-butyl, and tert-butyl; $C_{1-8}$O-alkyl, for instance methoxy, ethoxy, n-propoxy, isopropoxy, n-butoxy, iso-butoxy, or tert-butoxy.

14. The lubricating composition according to claim 1, wherein Y is $NR^{n1}$, Z is $NR^{n2}$, and $R^{n1}$ is $C_{1-8}$alkyl, for instance, methyl, ethyl, n-propyl, isopropyl, n-butyl, iso-butyl, and tert-butyl, $R^{n2}$ is $C_{1-8}$alkyl, for instance, methyl, ethyl, n-propyl, isopropyl, n-butyl, iso-butyl, and tert-butyl, and $R^2$ is hydrogen or methyl.

15. The lubricating composition according to claim 1, wherein the calcium complex has the formula:

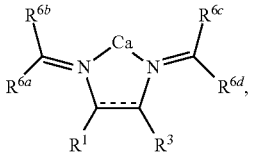

wherein $R^{6a}$ and $R^{6d}$ are independently selected from hydrogen or $C_{1-8}$alkyl, and $R^{6b}$ and $R^{6c}$ are each

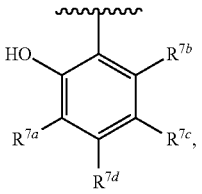

in which $R^{7a}$, $R^{7b}$, $R^{7c}$, and $R^{7d}$ are independently selected from hydrogen, hydroxyl, $C_{1-8}$alkyl, and O—$C_{1-8}$alkyl; wherein any two or more of $R^{7a}$, $R^{7b}$, $R^{7c}$, and $R^{7d}$ can together form a ring.

16. The lubricating composition according to claim 1, wherein the calcium chelate complex has the formula:

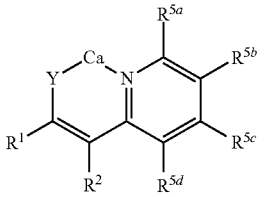

wherein $R^{5a}$, $R^{5b}$, $R^{5c}$, and $R^{5d}$ are independently selected from hydrogen; hydroxy; $C_{1-22}$alkyl, for instance, methyl, ethyl, n-propyl, isopropyl, n-butyl, iso-butyl, and tert-butyl, pentyl, hexyl, heptyl, octyl, nonyl, decyl, undecyl, dodecyl; $C_{1-22}$O-alkyl, for instance methoxy, ethoxy, n-propoxy, isopropoxy, n-butoxy, iso-butoxy, or tert-butoxy; wherein any two or more of $R^2$, $R^{5a}$, $R^{5b}$, $R^{5c}$, and $R^{5d}$ can together form a ring.

17. A lubricating composition, comprising a base oil and at least one cyclic chelate complex, wherein the cyclic calcium chelate complex is the reaction product a calcium compound and a ligand having the formula:

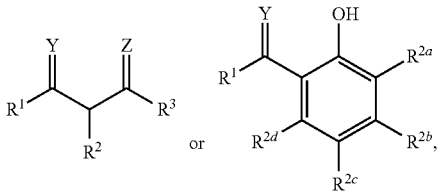

wherein

Y is selected from O, S, $NR^{n1}$;

Z is selected from O, S, $NR^{n2}$;

$R^1$, $R^2$, $R^3$, $R^{n1}$, and $R^{n2}$ are independently selected from $R^a$, $OR^b$, and $N(R^b)_2$;

wherein $R^a$ is in each case independently selected from hydrogen, $C_{1-8}$alkyl, $C_{2-8}$alkenyl, $C_{2-8}$alkynyl, aryl, $C_{1-8}$heteroaryl, $C_{3-8}$cycloalkyl, or $C_{1-8}$heterocyclyl;

$R^b$ is in each case independently selected from $C_{1-8}$alkyl, $C_{2-8}$alkenyl, $C_{2-8}$alkynyl, aryl, $C_{1-8}$heteroaryl, $C_{3-8}$cycloalkyl, or $C_{1-8}$heterocyclyl;

wherein $R^{2a}$, $R^{2b}$, $R^{2c}$, and $R^{2d}$ are independently selected from hydrogen; hydroxy; $C_{1-22}$alkyl; and O—$C_{1-22}$alkyl; wherein any two or more R groups can together form a ring.

18. A lubricating composition comprising a base oil and at least one cyclic calcium chelate complex, wherein the calcium chelate complex is the reaction product of a calcium compound and a ligand compound having the formula:

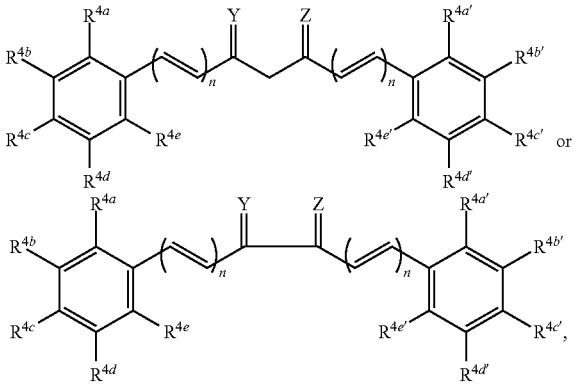

wherein n is 0, 1 or 2; and $R^{4a}$, $R^{4a'}$, $R^{4b}$, $R^{4b'}$, $R^{4c}$, $R^{4c'}$, $R^{4d}$, $R^{4d'}$, $R^{4e}$, and $R^{4e'}$ are independently selected from hydrogen; hydroxy; $C_{1-22}$alkyl, for instance, methyl, ethyl, n-propyl, isopropyl, n-butyl, iso-butyl, and tert-butyl, pentyl, hexyl, heptyl, octyl, nonyl, decyl, undecyl, dodecyl; $C_{1-22}$O-alkyl, for instance methoxy, ethoxy, n-propoxy, isopropoxy, n-butoxy, iso-butoxy, or tert-butoxy; wherein any two or more of $R^{4a}$, $R^{4a'}$, $R^{4b}$, $R^{4b'}$, $R^{4c}$, $R^{4c'}$, $R^{4d}$, $R^{4d'}$, $R^{4e}$, and $R^{4e'}$ can together form a ring, preferably $R^{4c}$ and $R^{4c'}$ are either hydroxyl or amino, preferably $R^{4b}$ and $R^{4b'}$ are each methoxy.

19. The lubricating composition according to claim 1, wherein the calcium chelate complex is the reaction product of a calcium compound and a ligand compound having the formula:

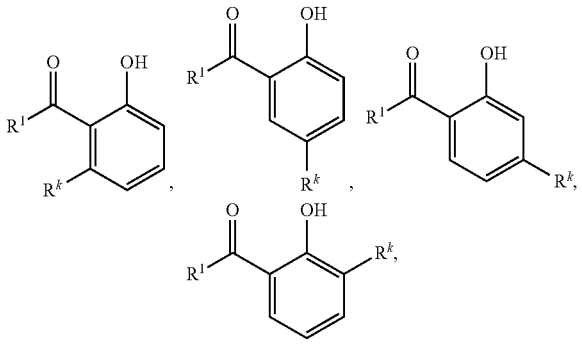

wherein $R^k$ is selected from hydroxyl, amino, $C_{1-22}$alkyl, for instance, methyl, ethyl, n-propyl, isopropyl, n-butyl, iso-butyl, and tert-butyl pentyl, hexyl, heptyl, octyl, nonyl, decyl, undecyl, dodecyl; and O—$C_{1-22}$alkyl, for instance methoxy, ethoxy, n-propoxy, isopropoxy, n-butoxy, iso-butoxy, or tert-butoxy.

20. The lubricating composition according to claim 1, wherein the calcium chelate complex is the reaction product of a calcium compound and a ligand compound having the formula:

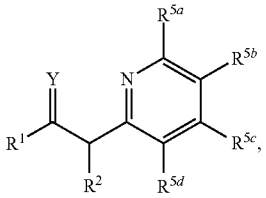

wherein $R^{5a}$, $R^{5b}$, $R^{5c}$, and $R^{5d}$ are independently selected from hydrogen; hydroxy; $C_{1-22}$alkyl, for instance, methyl, ethyl, n-propyl, isopropyl, n-butyl, iso-butyl, and tert-butyl, pentyl, hexyl, heptyl, octyl, nonyl, decyl, undecyl, dodecyl; $C_{1-22}$O-alkyl, for instance methoxy, ethoxy, n-propoxy, isopropoxy, n-butoxy, iso-butoxy, or tert-butoxy; wherein any two or more of $R^2$, $R^{5a}$, $R^{5b}$, $R^{5c}$, and $R^{5d}$ can together form a ring.

21. The lubricating composition according to claim 1, wherein the calcium chelate complex is the reaction product of a calcium compound and a ligand compound having the formula:

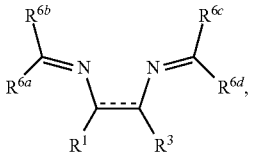

wherein $R^{6a}$ and $R^{6d}$ are independently selected from hydrogen or $C_{1-8}$alkyl, and $R^{6b}$ and $R^{6c}$ are each

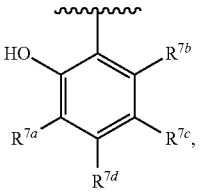

in which $R^{7a}$, $R^{7b}$, $R^{7c}$, and $R^{7d}$ are independently selected from hydrogen, hydroxyl, $C_{1-8}$alkyl, and O—$C_{1-8}$alkyl; wherein any two or more of $R^{7a}$, $R^{7b}$, $R^{7c}$, and $R^{7d}$ can together form a ring.

22. The lubricating composition according to claim 17, wherein the molar ratio of calcium compound to ligand compound is about 1:1, 1:2, or 1:3.

23. The lubricating composition according to claim 17, wherein the calcium compound comprises a calcium base.

24. The lubricating composition according to claim 17, wherein the calcium compound comprises a calcium salt.

25. The lubricating composition according to claim 1, wherein the calcium chelate complex is present in about an amount from 100-3,000 ppm, from 200 to 3000 ppm, or from 250 to 2500 ppm, from 300 to 2500 ppm, from 350 to 2500 ppm, from 400 ppm to 2500 ppm, from 500 to 2500 ppm, from 600 to 2500 ppm, from 700 to 2500 ppm, from 700 to 2000 ppm, from 700 to 1500 ppm.

26. A method of preventing or reducing low speed pre-ignition events in an internal combustion engine having a crankcase, comprising contacting the crankcase with the lubricating composition according to claim 1.

27. The method of claim 26, wherein the internal combustion engine is a spark-ignited internal combustion engine.

28. The method of claim 26, wherein the internal combustion engine experiences no more than 90%, no more than 80%, no more than 70%, no more than 60%, no more than 50%, no more than 40%, no more than 30%, no more than 20%, no more than 10%, or no more than 5% of the low speed pre-ignition events experienced by an internal combustion engine lubricated with an otherwise same lubricating composition that do not include the calcium cyclic chelate complex.

29. The method of claim 26, wherein the internal combustion engine experiences no more than 10 LSPI events over at least 100,000 combustion cycles, no more than 8 LSPI events over at least 100,000 combustion cycles, no more than 6 LSPI events over at least 100,000 combustion cycles, no more than 4 LSPI events over at least 100,000 combustion cycles, no more than 2 LSPI events over at least 100,000 combustion cycles, or no more than 1 LSPI event over at least 100,000 combustion cycles.

30. A method of reducing or preventing corrosion in an internal combustion engine having a crankcase, comprising contacting the crankcase with the lubrication composition according to claim 1.

31. The method according to claim 30, wherein the lubricating composition provides a ball rust test score (as measured by ASTM D6557) of at least 100, at least 110, at least 120, or at least 130.

* * * * *